US006879235B2

(12) United States Patent
Ichikawa

(10) Patent No.: US 6,879,235 B2
(45) Date of Patent: Apr. 12, 2005

(54) TRANSFORMER

(75) Inventor: Tomoyuki Ichikawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 24 days.

(21) Appl. No.: 10/420,439

(22) Filed: Apr. 22, 2003

(65) Prior Publication Data

US 2003/0201859 A1 Oct. 30, 2003

(30) Foreign Application Priority Data

Apr. 30, 2002 (JP) ..... P. 2002-128191

(51) Int. Cl.[7] ..... H01F 5/00

(52) U.S. Cl. ..... 336/200; 336/232; 336/212; 336/223

(58) Field of Search ..... 336/223, 200, 336/232, 212, 83; 29/602.1

(56) References Cited

U.S. PATENT DOCUMENTS 4,901,048 A * 2/1990 Williamson ..... 336/180
5,010,314 A * 4/1991 Estrov ..... 336/198
5,175,525 A * 12/1992 Smith ..... 336/83
5,559,487 A * 9/1996 Butcher et al. ..... 336/178
5,684,445 A * 11/1997 Kobayashi et al. ..... 336/83
6,114,932 A * 9/2000 Wester et al. ..... 336/65
6,211,767 B1 * 4/2001 Jitaru ..... 336/200
6,377,153 B1 4/2002 Yamanaka et al.
6,617,948 B2 * 9/2003 Kuroshima et al. ..... 336/83

FOREIGN PATENT DOCUMENTS

| | | |
|---|---|---|
| EP | 0 932 169 | 7/1999 |
| EP | 0 933 789 | 8/1999 |
| JP | 09134827 | 5/1997 |
| JP | 200009113 | 3/2000 |
| JP | 2001-126895 | 11/2001 |

* cited by examiner

*Primary Examiner*—Anh Mai
(74) *Attorney, Agent, or Firm*—Fish & Richardson P.C.

(57) ABSTRACT

A transformer is provided with a coil portion containing primary windings and a secondary winding. Cores sandwich the coil portion. Each of these windings includes a toroidal-shaped portion that is formed by winding flat type wires in a toroidal shape and by overlapping these flat type wires. Edge portions of this flat type wire are derived from the toroidal-shaped portion respectively. A plurality of windings and the cores are arranged along an overlapping direction of the flat type wires. employed, By this structure, a copper loss caused by the skin effect can be reduced and the electromagnetic coupling conditions between the windings can be improved.

7 Claims, 13 Drawing Sheets

TRANSFORMER

BACKGROUND OF THE INVENTION

1. Field of the Invention

The present invention is related to a technique of compacting a high-frequency-purpos transformer by reducing a copper loss (load loss) and by improving electromagnetic coupling of windings (coils).

2. Description of the Related Art

An ignition circuit for discharge lamps such as a metal halide lamp is generally equipped with a DC-to-DC converting circuit, a DC-to-AC converting circuit, and a starting circuit. A pulse-width modulation (PWM) system and a pulse-frequency modulation (PFM) system are used as a control system for switching power supply circuit which constitutes a DC-to-DC converting circuit (DC-to-DC converter).

When a flyback type structure is used as a DC-to-DC converting circuit, a converting transformer (converter transformer) is required, and a construction suitable for a high-frequency switching control operation is required in order to make this converter transformer compact.

When circular wires are employed as windings (coils), a skin effect caused by high-frequency currents may present a problem. That is, copper losses can increased and electromagnetic coupling conditions can degrade with the circular wire windings.

This skin effect may effectively reduce a sectional area for current flow when a high-frequency current flows through a conductor because the high-frequency current may be restricted to flow only in a certain limited area of a conductor surface. For a circular wire, copper losses may increase because an effective volume of high-frequency current may not be sufficiently secured as compared to a volume of a winding of this circular wire.

A transformer made of an alternately-overlapping arrangement (so-called "sandwich winding") has respective coils (windings) that are sequentially wound with respect to a cylindrical portion which constitutes a coil bobbin. To use this transformer in a high frequency field, a total turn number of the coils must be small in order to reduce the inductance. If a circular type wire is used in such a transformer, an electromagnetic coupling characteristic between a primary winding (primary coil) and a secondary winding (secondary coil) would deteriorate because of air gaps between the sandwich windings.

SUMMARY OF THE INVENTION

In the present invention, a copper loss is reduced and a coupling characteristic between windings is improved. Also, a high-frequency transformer can be made compact.

A transformer, according to one embodiment of the present invention, includes: a coil portion including a plurality of windings; and a plurality of cores arranged so that the cores sandwich the coil portion. The winding has a toroidal-shaped (ring-shaped) portion which is formed by winding a flat type wire in a toroidal shape to overlap with each other. Both edge portions of the flat type wire are derived or extend from the toroidal-shaped portion. The plurality of windings and the plurality of cores are arranged in a direction along which the flat type wire overlaps.

When such a flat type wire is employed, a copper loss caused by the skin effect can be reduced. Also, because the toroidal-shaped portion is formed by winding this flat type wire in the overlapping manner, where both the respective windings and the respective cores are arranged along the overlapping direction of the flat type wire, the electromagnetic coupling conditions in the windings can be improved.

DETAILED DESCRIPTION OF THE PREFERRED EMBODIMENTS

The present invention is related to a transformer equipped with a coil unit containing a plurality of coils (windings), and a plurality of cores. The coil unit is sandwiched by the plural cores. The transformer has a structure suitable for high-frequency. An exemplary use of this transformer as applied to an ignition circuit of a discharge lamp will be described below.

Figure 1:
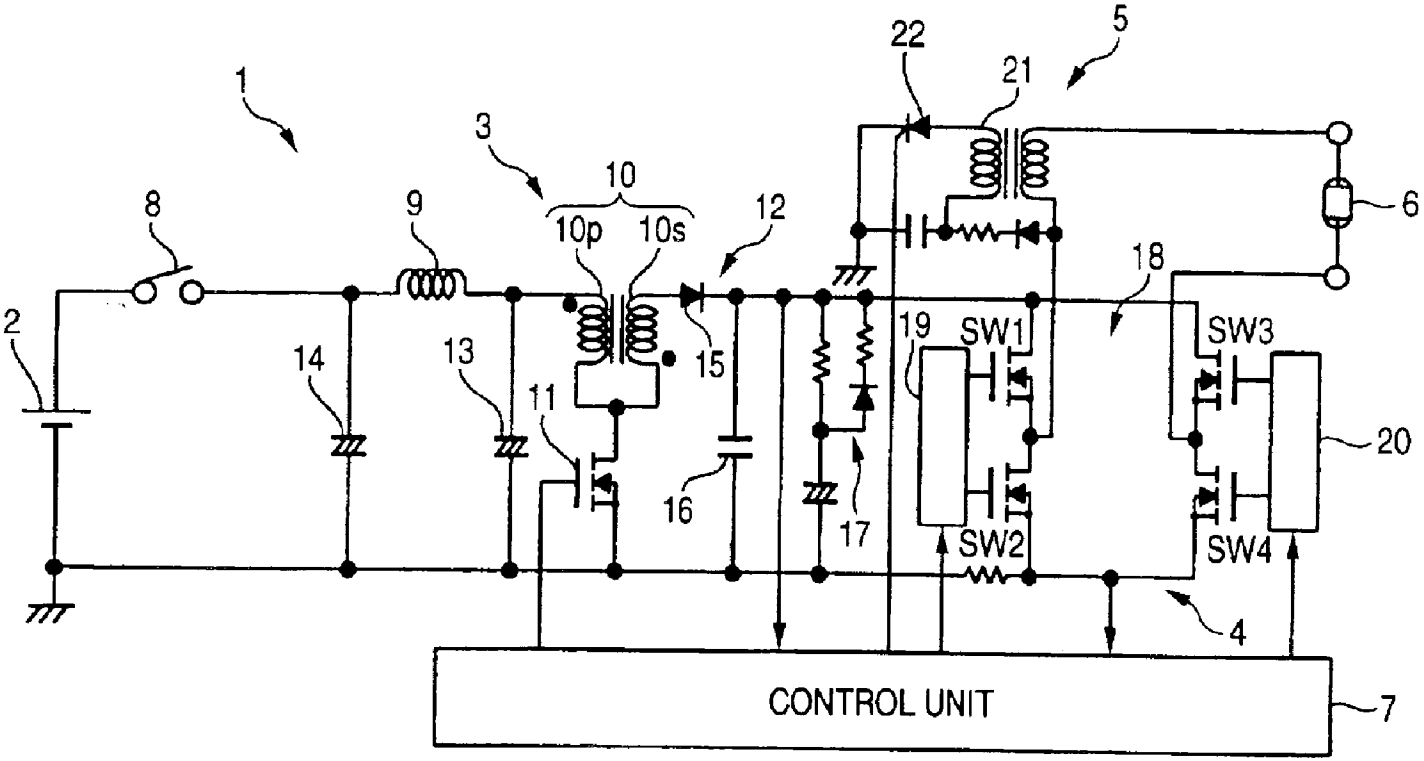
FIG. 1 is a diagram for showing an embodiment of a discharge lamp ignition circuit.

FIG. 1 represents a structural example of a discharge lamp ignition circuit.

A discharge lamp ignition circuit 1 is provided with a DC power supply 2, a DC-to-DC converting circuit 3, a DC-to-AC converting circuit 4, a starting circuit 5, and a control unit 7 for controlling ON/OFF operations of a discharge lamp 6.

The DC-to-DC converting circuit 3 receives an input voltage from the DC power supply 2, and then, converts this received DC voltage into a desirable DC voltage. In this example, a flyback type DC-to-DC converter can be employed as the DC-to-DC converting circuit 3.

In other words, the DC input voltage which is applied via an ignition switch 8 connected to a positive polarity side of the DC power supply 2 may be applied via an inductor 9 to a primary winding side of a transformer 10. The DC-to-DC converting circuit 3 includes a switching element 11 and a rectifying/smoothing circuit 12. The switching element 11 is connected to a primary winding 10*p* of this transformer 10. The rectifying/smoothing circuit 12 is provided on the side of a secondary winding 10*s* of this transformer 10.

In FIG. 1, because black circles are applied to the respective windings 10*p* and 10*s* of the transformer 10, starting points of these windings 10*p* and 10*s* are clearly indicated (namely, black circles indicate polarities of windings).

Both the inductor 9 and a capacitor 13 are connected to a winding starting-sided terminal of the primary winding 10*p*, whereas one end (winding starting-sided terminal) of the secondary winding 10*s* and also a switching element 11 are connected to a winding end-sided terminal of this primary winding 10*p*. A signal derived from the control unit 7 is supplied to the switching element 11. The switching element 11, in this example, is an N-channel MOS type FET (field-effect transistor). While a drain of this FET is connected to one end of the winding 10*p* and also one end of the winding 10*s*. A source thereof is grounded and a control signal is supplied to a gate of this FET to turn the the FET on or off.

One end of the capacitor 14 is connected to a terminal (on the side of ignition switch 8) of the inductor 9, and the other end of this capacitor 14 is grounded.

On the secondary winding side of the transformer 10, a rectifying diode 15 and a smoothing capacitor 16 are provided, which constitute the above-explained rectifying/smoothing circuit 12. In other words, the winding end-sided terminal of the transformer 10 is connected to an anode of the rectifying diode 15, and a cathode of this rectifying diode 15 is connected to one end of the smoothing capacitor 16. The other end of the smoothing capacitor 16 is grounded.

A circuit 17 arranged at a post stage of the DC-to-DC converting circuit 3 stabilizes a turn-ON state at a initial stage of the discharging lamp 6. In this example, the circuit 17 includes a series circuit constructed of a resistor and a capacitor and another series circuit made of a diode and a resistor, which is connected in parallel to the first-mentioned resistor.

The DC-to-AC converting circuit 4 is provided so that a DC output voltage of the DC-to-DC converting circuit 3 is converted into an AC voltage. Thereafter, this AC voltage is applied via the starting circuit 5 to the discharge lamp 6. The DC-to-AC converting circuit 4 is equipped with, for example, a bridge type circuit 18 and drive circuits 19/20 for this bridge type circuit 18. The bridge type circuit 18 includes four semiconductor switching elements SW1 to SW4 (for example, FETs). This DC-to-AC converting circuit 4 alternately controls to turn ON/OFF two sets of switching element pairs to output the AC voltage.

The starting circuit (so-called "starter") 5 is provided so that a high-voltage pulse signal (starting pulse) for starting the discharge lamp 6 is generated, and this discharge lamp 6 is ignited by this high-voltage pulse signal. The high-voltage pulse signal is superimposed on the AC voltage output from the DC-to-AC converting circuit 4. The superimposed pulse signal is applied to the discharge lamp 6. The starting circuit 5 includes a transformer 21, a thyristor 22 provided on the primary winding side of this transformer 21, and other circuit elements (resistor, diode, capacitor). A signal supplied from the control unit 7 is supplied to a gate of the thyristor 22.

A junction point (connection point) between the above-described switching elements SW1 and SW2 is connected via a secondary winding of the transformer 21 to one end of the discharge lamp 6, whereas the other end of the discharge lamp 6 is connected to another junction point between the above-explained switching elements SW3 and SW4.

The control unit 7 controls electric power supplied to the discharge lamp 6 by receiving such detection signals related to a voltage applied to the discharge lamp 6 and a current flowing through the discharge lamp 6, or a voltage and a current, which are relevant to these voltage/current. Also, the control unit 7 controls the output of the DC-to-DC converting circuit 3. For example, for the control unit 7 to receive detection signals related to both an output voltage and an output current of the DC-to-DC converting circuit 3 and to control the supplied electric power in response to a condition of the discharge lamp 6, the control unit 7 sends out a control signal with respect to the switching element 11 of the DC-to-DC converting circuit 3 to control the output voltage thereof (PWM control system and PFM control system are known as switching control system). Also, the control unit 7 sends control signals to the drive circuits 19 and 20 of the DC-to-AC converting circuit 4 to control the operation of the bridge type circuit (namely, full-bridge type circuit in this example). Furthermore, the control unit 7 performs an output control operation to firmly turn ON the discharge lamp 6 by increasing the supply voltage to this discharge lamp 6 to a certain voltage level before the discharge lamp 6 is turned ON.

On the other hand, for the transformer 10, which constitutes the DC-to-DC converting circuit 3, to be made compact, a switching control operation is set at a higher frequency (e.g. on the order of 400 to 500 Kilohertz) with regard to the switching element 11. If the ignition circuit 1 of the discharge lamp is used in an automobile lighting purpose, the switching frequency must be eliminated from the radio frequency band to eliminate noise. For example, with respect to the LW band (150 to 280 KHz) and the AM band (500 to 1,700 KHz), a frequency band between 400 KHz and 500 KHz, which is located between both the LW band and the AM band may be preferably selected.

As previously explained, when a circular type wire (whose sectional shape is circular) is used as a winding of a transformer, the effective sectional area of the current path may decreasebecause of the skin effect. This reduction in area may cause the increase of the copper loss which would lower the electrical efficiency.

Figure 2:
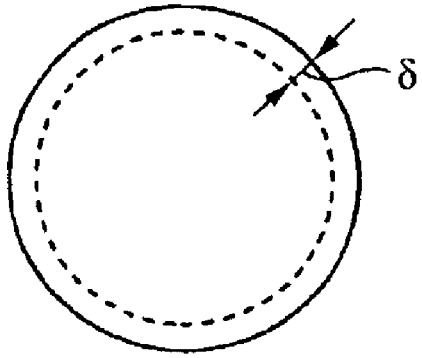
FIG. 2 is a diagram for explaining a skin effect in conjunction with FIG. 3, and is a sectional view of a circular type wire.

With respect to the skin effect, assume that a distance measured from a surface of a conductor is expressed as "x", and a skin thickness is expressed as "σ", and also, an exponential function of a variable "X" is expressed as "exp(X)." The current density changes according to "exp(−x/σ)," and therefore, the smaller the skin thickness "σ" becomes, the smaller the effective sectional area of the current path. The skin thickness "σ" corresponds to a thickness at which current density becomes "1/e", and symbol "e" indicates the base of a natural logarithm. The skin thickness "σ" is inversely proportional to a root-mean-square of an angular frequency "ω" (namely, frequency "f" multiplied by 2π), so that the higher frequency means smaller skin thickness, "σ." Thus, as shown in FIG. 2, when a circular type wire is used as the winding of the transformer 10, a current will flow only in a range defined from an external surface of the circular sectional area thereof up to an area nearly equal to the skin thickness, "σ." In other words, because substantially no current may flow in an internal area (namely, within circular frame of broken line in FIG. 2) inside the above-described range, a ratio of an ineffective area to the entire sectional area is increased.

Figure 3:
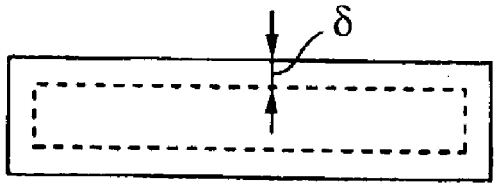
FIG. 3 shows a section of a flat type wire.

In contrast, in accordance with the present invention, a flat type wire is used as the respective windings of the transformer 10. As shown in FIG. 3, a current will flow in a range defined from an outer surface of a rectangular sectional area of the flat type wire up to an area nearly equal to the skin thickness "σ," but substantially no current may flow in an inner area (namely, within rectangular frame indicated by broken line of FIG. 3) from the above-described area. However, a ratio of an ineffective area as to a current path with respect to the entire sectional area of this flat type wire becomes smaller than that of the circular type wire.

Alternatively, because a so-called edgewise winding mode is used so that a flat type wire is wound to overlap with each other in a torodial coil shape, a transformer having a minimum size can be made, while suppressing a copper loss. For example, when the frequency is selected to be 400 to 500 KHz for a copper wire, the skin thickness "σ" is approximately 0.1 mm, and therefore, an optimum value as a thickness of a flat type copper wire would be approximately 0.2 mm. As previously explained, because a turn number of windings of a transformer in a high frequency field is small, the total thickness of those windings is not so thick.

One reason why a transformer can be made compact by employing a flat type wire is due to the improvement of a wire stacking ratio. In other words, because the circular type wire has a circular sectional shape, an unnecessary space is produced, and a bobbin is required for a winding of this circular type wire. In contrast, because the flat type wire has a rectangular sectional shape, substantially no useless space is produced between windings of this flat type wire. Therefore, a space utilization ratio is high, and a sectional area of the winding can be increased, and thus, a resistance value thereof can be low.

Figure 4:
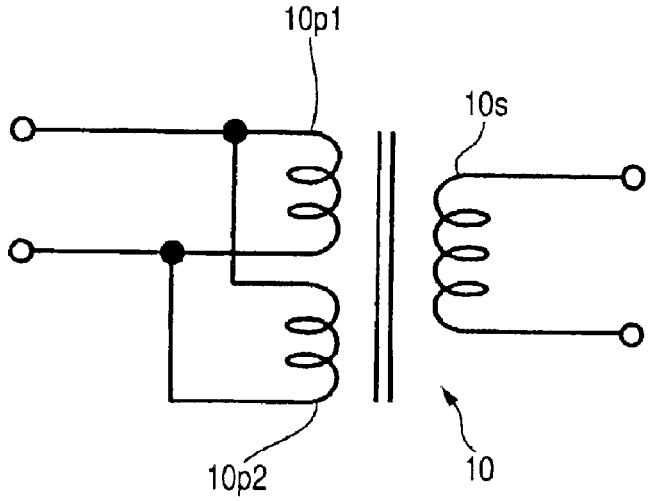
FIG. 4 is a diagram for explaining a construction of a transformer according to an embodiment of the present invention.
Figure 5:
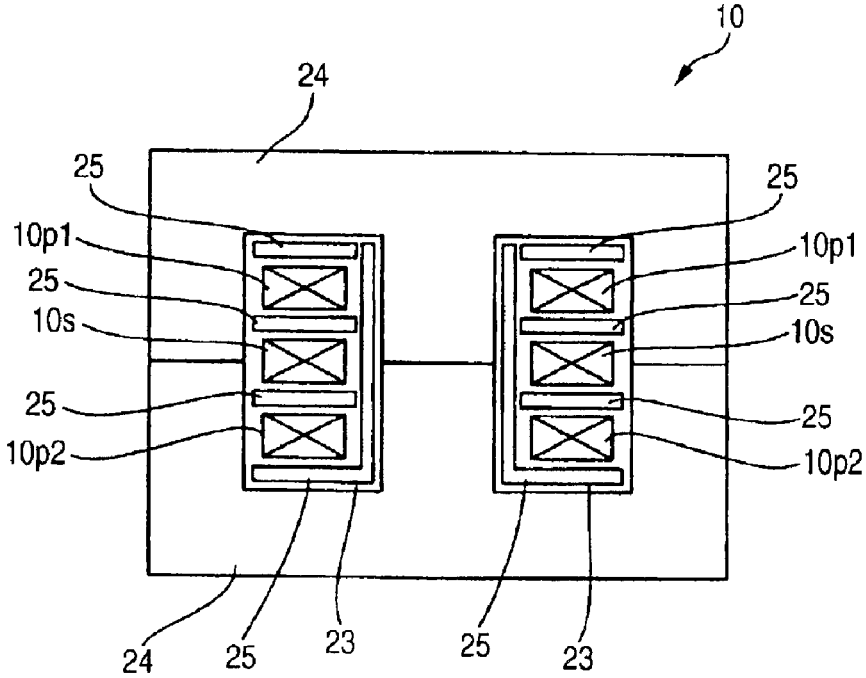
FIG. 5 is a sectional view for showing a sectional construction of the transformer.

FIG. 4 and FIG. 5 provide a structural example of the transformer 10. FIG. 4 is a circuit diagram of the transformer 10 and FIG. 5 is a schematic diagram of a sectional construction thereof.

In this example, a primary winding of the transformer 10 includes two windings 10*p*1 and 10*p*2 that are connected in parallel with each other.

If the above-described ignition circuit 1 is used, for example, in a light source (discharge lamp) device of an automobile, then this construction may effectively increase a coupling between the primary winding and the secondary winding of the transformer 10 because a primary current of the transformer 10 is considerably larger than a secondary current thereof in the DC-to-DC converting circuit 3. The primary winding of the transformer 10 is subdivided into a plurality of subdivided windings, and the secondary winding is sandwiched between the subdivided primary windings.

As shown in FIG. 5, the coil unit 23 containing a plurality of windings (10*p*1, 10*p*2, 10*s*) is sandwiched by two cores 24 and 24.

The cores 24 and 24 correspond to ferrite cores and sectional shapes thereof are E-character shapes, and the coil unit 23 is disposed in a space defined between both the ferrite cores, which have the E-character shapes and being directed to each other.

The coil unit 23 includes the respective windings using the flat type wire, and insulating members 25, which are provided among the windings and also between the windings and the cores 24. The secondary winding 10*s* is positioned between the primary windings 10*p*1 and 10*p*2. An insulating spacer (ring-shaped member) can be used to insulate the spaces among the windings. Also, either insulating spacers (ring-shaped members) or cylindrical-shaped insulating members equipped with flanges (corresponding to below-mentioned seatings) can be used to insulate spaces among the cores 24 and the respective windings.

Figure 6:
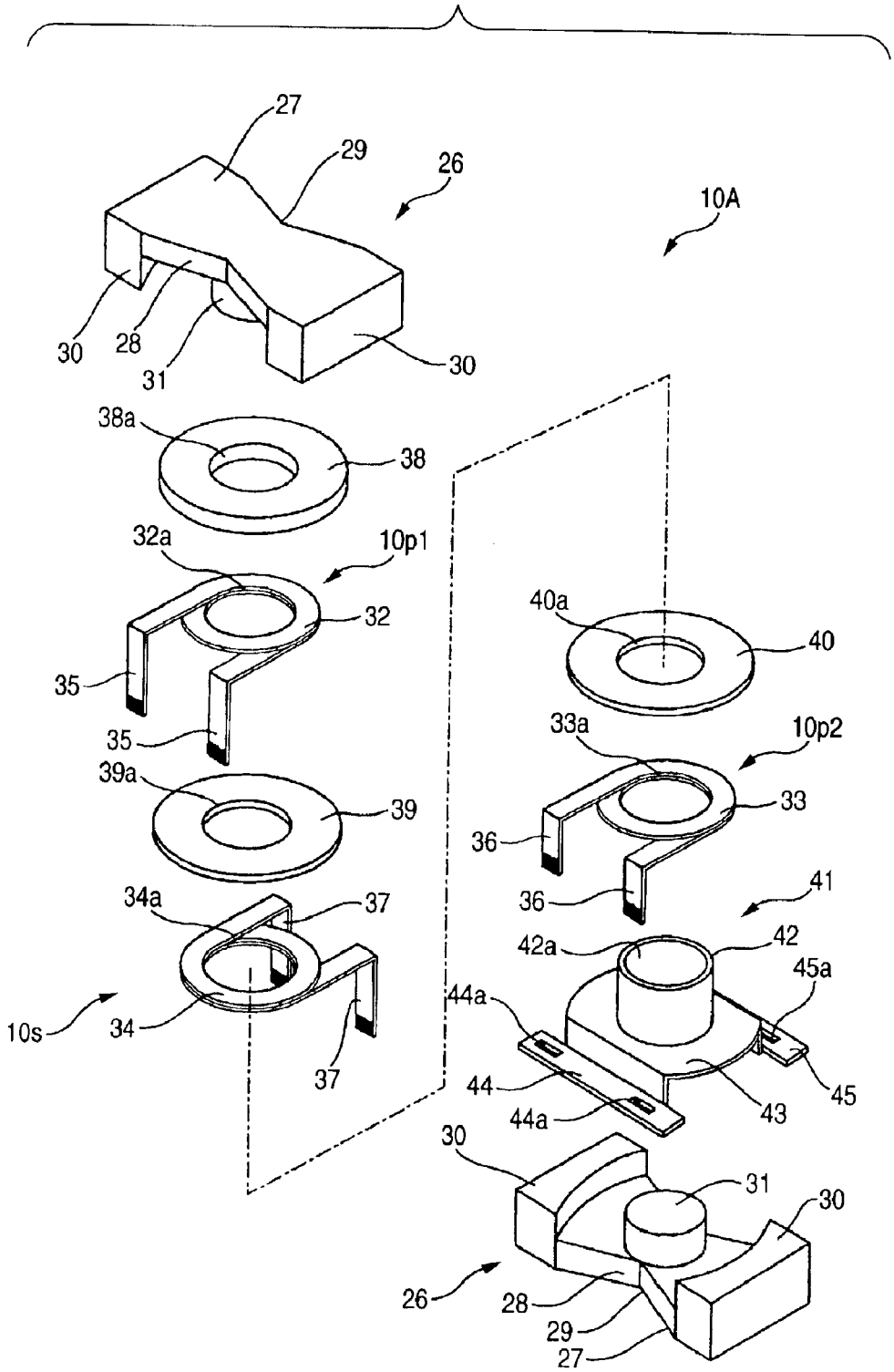
FIG. 6 is an exploded sectional view for indicating an embodiment of the transformer according to the present invention.

FIG. 6 shows a structural example 10A of a transformer according to the present invention.

Because both the ferrite cores 26 have the same shape, one of these ferrite cores 26 will be explained. Because side surfaces 28 of a major portion 27 having a substantially rectangular shape are tapered, a center portion 29 is bundled and both edge portions 30 have thick portions. Then, a projection portion 31 having a circular cylinder is formed on one surface of the center portion 20 in integral form. A sectional shape has an E-character shape, which is obtained by cutting a core at a flat plane which contains a center axis of the projection portion 31 and is located in parallel to a longitudinal direction of the major portion 27.

Any of the windings 10*p*1, 10*p*2, and 10*s* is formed by an edgewise winding, and has a toroidal-shaped (ring-shaped) portion which is formed by winding and overlapping a flat type wire in a toroidal shape. In other words, a circular hole 32*a* is formed in a toroidal-shaped portion 32 of the primary winding 10*p*1, another circular shape 33*a* is formed in another toroidal-shaped portion 33 of the primary winding 10*p*2, and another circular hole 34*a* is formed in another toroidal-shaped portion 34 of the secondary winding 10*s*.

Then, both edge portions of the flat type wire (flat type winding) are drawn from the respective toroidal-shaped portions 23, 33, 34 as connecting terminals, and are bent in an L-character shape. Terminals 35 correspond to the terminals of the primary winding 10*p*1, terminals 36 correspond to the terminals of the primary winding 10*p*2, and terminals 37 correspond to the terminals of the winding 10*s*. In this drawing, tip portions of the terminals which are bent in the L-character shapes are discriminated from other portions by using black-colored lines. Those tip portions of the terminals are fixed to seatings after covers of wire materials have been stripped. The lengths of the L-shaped bent portions are made different from each other at every winding; the closer the winding is located near the seating, the shorter the length thereof becomes. The respective terminals of the primary windings 10*p*1 and 10*p*2 are directed to the same direction, whereas the terminals of the secondary winding 10*s* are directed opposite to the above-described direction.

A spacer 38 is positioned between the primary winding 10*p*1 and the ferrite core 26 (namely, core indicated at upper portion of FIG. 6), another spacer 39 is positioned between the primary winding 10*p*1 and the secondary winding 10*s*, and another spacer 40 is located between the secondary winding 10*s* and the primary winding 10*p*2. Each of these spacers 38, 39, 40 is an insulating spacer and has a toroidal (ring) shape. Central circular holes (38*a*, 39*a*, 40*a*) are formed in these spacers 38, 39, 40.

A seating 41 is formed by using an insulating material to insulate spaces among the respective windings and the ferrite core 26. The seating 41 has a cylindrical portion 42 and a base portion 43 which supports this cylindrical portion 42. In other words, an outer diameter of the cylindrical portion 42 is made slightly smaller than a diameter of each of the circular holes formed in the toroidal-shaped portions 32 to 34 of the above-described windings. The cylindrical portion 42 is inserted into the circular holes of the spacers and the respective windings and the spacers are arranged along the overlapping direction of the flat type wires. An inner diameter of the cylindrical portion is larger than outer diameters of the projection portions 31 of the ferrite cores 26. Those projection portions 31 may be positioned opposite to each other by inserting them into the hole 42*a* of the cylindrical portion 42.

One edge portion of the base portion 43 having a flat-plate shape is bent in an L-character shape, and another edge portion located opposite to the first-mentioned edge portion is also bent in an L-character shape. The base portion 43 is formed in a channel shape. Those edge portions constitute a fixing portion 44 and another fixing unit 45, which are employed to fix the terminals 35 to 37 of the respective windings 10*p*1, 10*p*2, and 10*s*. In other words, one pair of rectangular holes are formed in a predetermined interval in each of these fixing portions 44 and 45 to insert the terminals of these windings. The terminals 35, 36 of the primary windings 10*p*1 and 10*p*2 are inserted into the rectangular holes 44*a* formed in one fixing portion 44. Because those primary windings are connected in parallel with each other as shown in FIG. 4, one ends of both windings are connected to each other and are inserted into rectangular holes respectively. Also, the terminals 37 of the secondary winding 10*s* are inserted into the rectangular holes 45*a* (see FIG. 7) formed in the other fixing portion 45 so as to be fixed. The seating 41 constitutes the above-described insulating member. Because the fixing portion of the winding terminal is integrally formed with this seating 41, the fixing portion is no longer arranged as another member. Therefore, the total number of structural components and manufacturing cost can be reduced.

Figure 7:
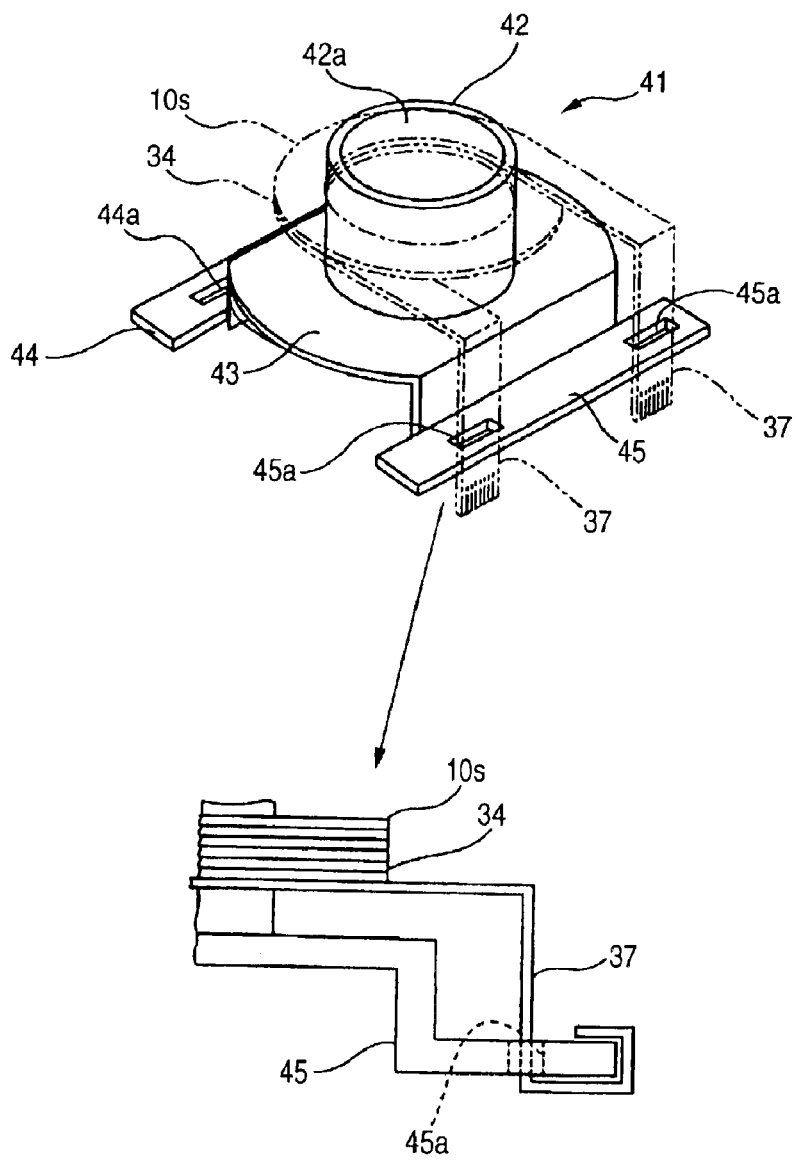
FIG. 7 is a diagram of portions of winding terminals of FIG. 6.

FIG. 7 schematically shows only a secondary winding and a seating and a construction of a deriving portion of a winding terminal. A portion of a wire member located near a tip portion thereof, which is derived outwardly from a toroidal-shaped (ring-shaped) portion of a winding (flat type winding), is inserted into a rectangular hole 45*a* formed in a fixing portion (namely, fixing portion 45 in this drawing) of the seating 41. Thereafter, the portion of the wire member is folded and mounted and bent in a "⊐"-character (roughly, reversed "C" character) shape along an edge of this fixing portion. With regard to a connection terminal, because a cover of the wire material is stripped, soldering reflowing of the transformer itself can be carried out. The connection terminal is electrically connected to a circuit board (not shown).

Shapes of the respective ferrite cores are substantially rectangles as viewed from a direction along which the flat type windings overlap with each other. This is because the respective windings can be derived from the side surface along a direction perpendicular to the longitudinal direction of the ferrite cores. In other words, for this transformer, the terminals of the first winding (namely, primary windings 10*p*1 and 10*p*2) can be derived from one side surface, whereas the terminals of the second winding (namely, secondary winding 10*s*) can be derived from the other side.

The respective windings and the ferrite cores are arranged along the overlapping direction of the windings (flat type windings). Those ferrite cores are fixed to each other by a fixing hardware or a tape to prevent separation so that both ferrite cores are sandwiched along the upper/lower direction of FIG. 6. Because spacers and/or seatings are interposed among those windings and between the windings and the cores, electrical insulating effects may be secured.

Figure 8:
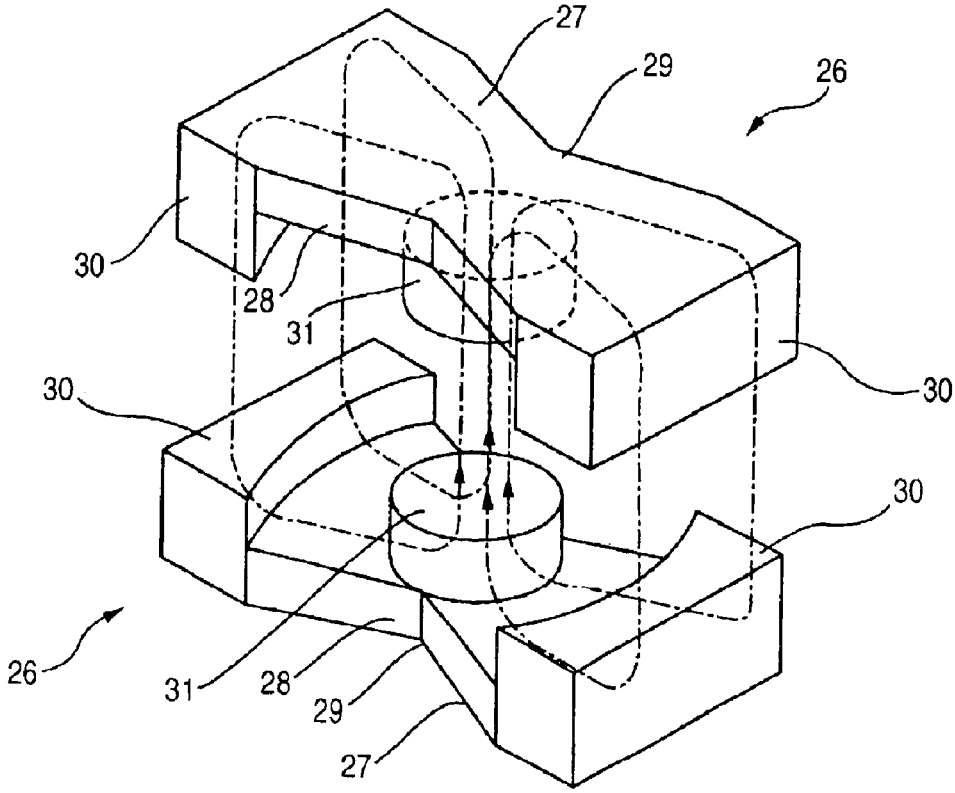
FIG. 8 is a diagram for showing magnetic flux which passes through a ferrite core.

FIG. 8 illustrates passing routes of magnetic flux (magnetic paths) formed in the ferrite cores 26 (both ferrite cores are showed under separate conditions).

Each of those ferrite cores 26 has both edge portions 30 of a major portion 27 that are employed as outer feet. Also, a projection portion 31 of a center portion 29 is employed as a middle foot, and these structural elements are located opposite to each other between both the ferrite cores 26. As indicated by a dot and dash line of this drawing, the magnetic flux which passes through the middle foot in one ferrite core 26 is divided into two sets of magnetic flux. The two sets of the subdivided magnetic flux pass through the outer feet of this ferrite core 26 respectively, and thereafter, enter into the outer feet of the other ferrite core 26. Then, two sets of the entered magnetic flux are collected to the middle foot, and the collected magnetic flux is again coupled to the middle foot of the first-mentioned core 26. That is, the magnetic flux derived from the middle foot of one ferrite core 26 is separated along two directions, and then, two sets of separated magnetic flux pass from the outer feet thereof via the outer feet of the other core 26, and are collected in the middle foot of this core 26. Also, the magnetic flux passing through the middle foot is made equal to a summation of two sets of the separated magnetic flux through the respective outer feet.

In the structure of FIG. 6, both edge portions of is the terminals of two sets of the primary windings 10*p*1 and 10*p*2 are coupled to each other to constitute the connection terminals. Those connection terminals are fixed to one fixing portion 44 to derive the terminals. Thus, the edge portions of the two primary windings are inserted into the same rectangular holes 44*a* and 44*a* of the fixing portion 44.

In terms of workability of wiring works, the following structural mode is preferably employed. That is, the fixing portions corresponding to the terminals of the respective windings are separately provided on the seatings, and the terminals of the windings with respect to the fixing portions are fixed thereon.

As shown in a structural example 10B of FIG. 9, the respective windings may be separately wired on the circuit board if primary and secondary windings 10*p*1, 10*p*2, 10*s* are arranged in the below-mention structural mode with respect to directions of the respective terminals related to the two primary windings 10*p*1 and 10*p*2 and the terminals of the secondary winding 10*s*. That is, these terminals are arranged in an angular interval of approximately 90 degrees around a center axis along an overlapping direction of these windings, as viewed in a direction along which these windings 10*p*1, 10*p*2, 10*s* overlap.

Because the structure of the ferrite cores 46 and the seating 51 of this example is different from the structure of FIG. 6, this difference will now be explained.

The ferrite cores 46 have the same shapes, and each of these ferrite cores 46 has four leg portions 47. Those leg portions 47 are formed in such an angular interval of approximately 90 degrees as viewed from a direction along which the windings overlap, and therefore, the entire leg portion forms a cross shape. Among those four leg portions, portions 48 thereof located near the edge portions have thicker-thickness. A projection portion 50 having a cylinder shape is formed integrally on one plane of a center portion 49 where those four leg portions 47 couple to each other. A sectional shape made by cutting the ferrite core 47 constitutes an E-character shape at a plane, which involves a center axis of this projection portion 50, and is located in parallel to such a longitudinal direction of the two leg portions 47 directed along the same direction.

As to the respective windings, drawing directions of terminals are different from each other. For instance, while the direction related to the terminals 36 of the primary winding 10*p*2 is used as a reference direction, a direction of both terminals 35 of the primary winding 10*p*1 is defined based upon an angle of 90 degrees around a center axis of a toroidal-shaped portion (ring-shaped portion), which is extended along the overlapping direction of the respective windings. Also, as to the secondary winding 10*s*, both terminals 37 thereof are situated at an angle of 180 degrees around this center axis (namely, direction opposite to direction related to primary winding 10*p*1). Lengths of L-shaped-bent portions of the respective terminals of those windings are different from each other. The closera winding is located with respect to the fixing portion of the seating 51, the shorter the length thereof is made.

A seating 51 (see FIG. 9 and FIG. 10) has a cylindrical portion 52 and a base portion 53 for supporting this cylindrical portion 52. However, the shape of the base portion 53 is different from the base structure of FIG. 6. In other words, as to the base portion 53, three sets of fixing portions 54, 55, and 56 are formed in order to fix the respective terminals of these primary/secondary windings 10*p*1, 10*p*2, and 10*s*. The fixing portion 54 connects to the primary winding 10*p*2, the fixing portion 55 connects to the primary winding 10*p*1, and the fixing portion 56 connects to the secondary winding 10*s*. As the directions of both the edge portions of the respective windings have the angular interval of 90 degrees, so are the orientations (directions of arrangement) of the respective fixing portions corresponding thereto made different from each other.

A base portion 53 is a circular plate that has a central circular hole and is combined with a rectangular plate. At four corners of this base portion 53, feet prices 54*a*,55*a*, and 56*a*, which are bent in L-character shapes are formed.

The fixing portion 54 includes feet pieces 54*a* which are formed on one-sided edge of the base portion 53. Notches 54*b* are formed in these feet pieces 54*a* of this fixing portion 54 along directions opposite to each other. After the terminals 36 of the primary winding 10*p*2 are inserted into the respective notches 54*b*, tip portions of these terminals 36 are bent in L-character shapes and then are fixed to the respective feet pieces 54*a*.

Similarly, the fixing portion 55 includes the feet pieces 55*a* which are formed on side edge located adjacent to the above-described one side edge within the base portion 53. Notches 55*b* are formed in these feet pieces 55*a* of this fixing portion 55 along directions opposite to each other. After the terminals 35 of the primary winding 10*p*1 are inserted into the respective notches 55*b*, tip portions of these terminals 35 are bent in L-character shapes and then are fixed to the respective feet pieces 55*a*. Also, the fixing portion 56 includes the feet pieces 56*a* (see FIG. 10), which are formed on side edge located opposite to the above-described one side edge related to the fixing portion 54. Notches 56*a* are formed in the feet pieces 56*a* of this fixing portion 56 along directions opposite to each other. After the terminals 37 of the secondary winding 10*s* are inserted into the respective notches 56*b*, tip portions of these terminals 37 are bent in L-character shapes and then are fixed to the respective feet pieces 56*a*.

Dimensional relationships among the projection portion 50 of the core 46, the cylindrical portion 52 of the seating 51, the spacers 38 to 40, and the toroidal-shaped portions 32 to 34 of the respective windings are similar to that of FIG. 6. That is, an outer diameter of the projection portion 50 is made smaller than an inner diameter of the cylindrical portion 52 (diameter of hole 52*a*), and also, an outer diameter of the cylindrical portion 52 is made smaller than a hole diameter of each of the spacers 38 to 40 and a hole diameter of each of the winding toroidal-shaped portions 32 to 34.

Figure 9:
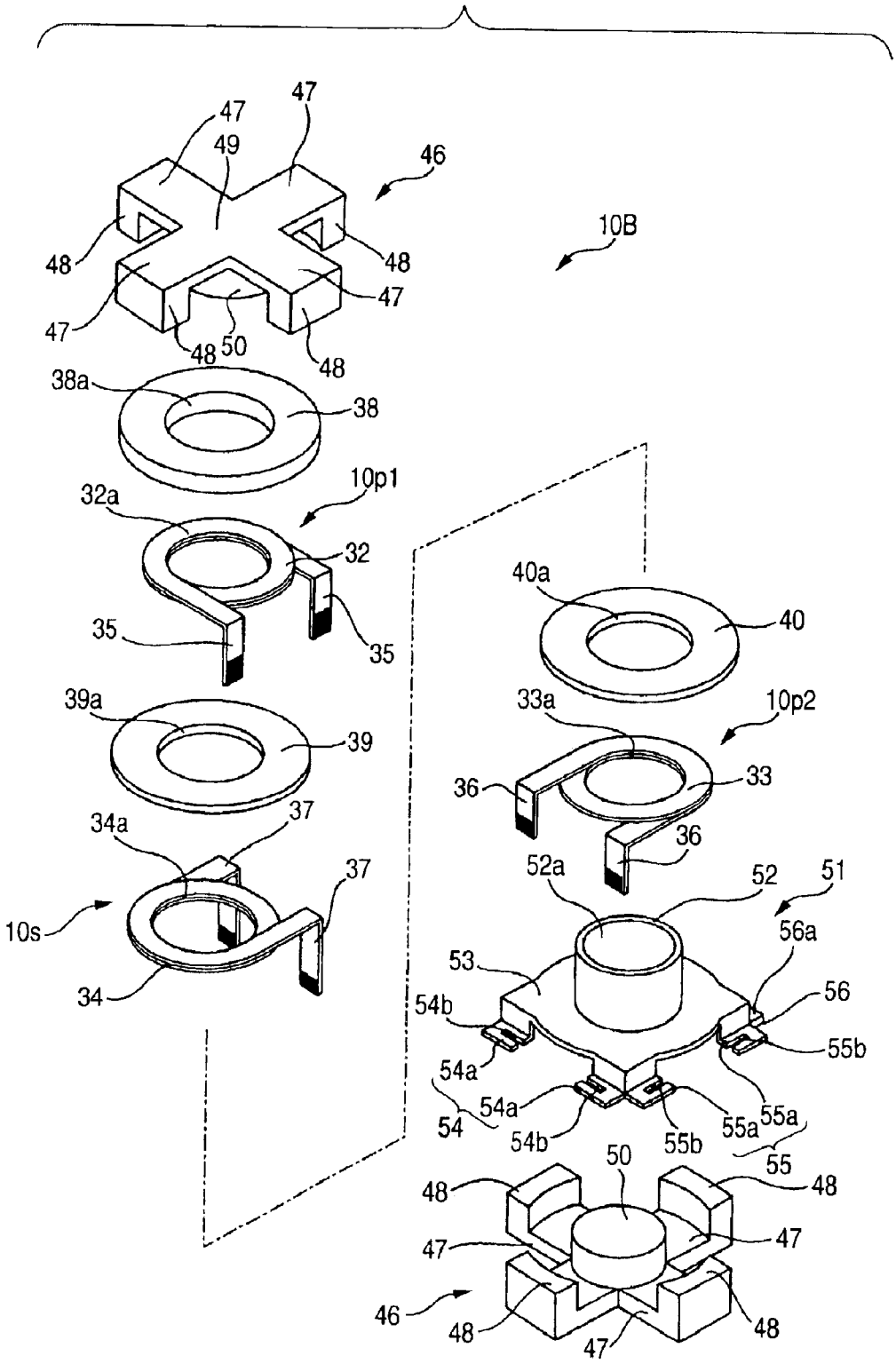
FIG. 9 is an exploded sectional view of a transformer according to one embodiment of the present invention.
Figure 10:
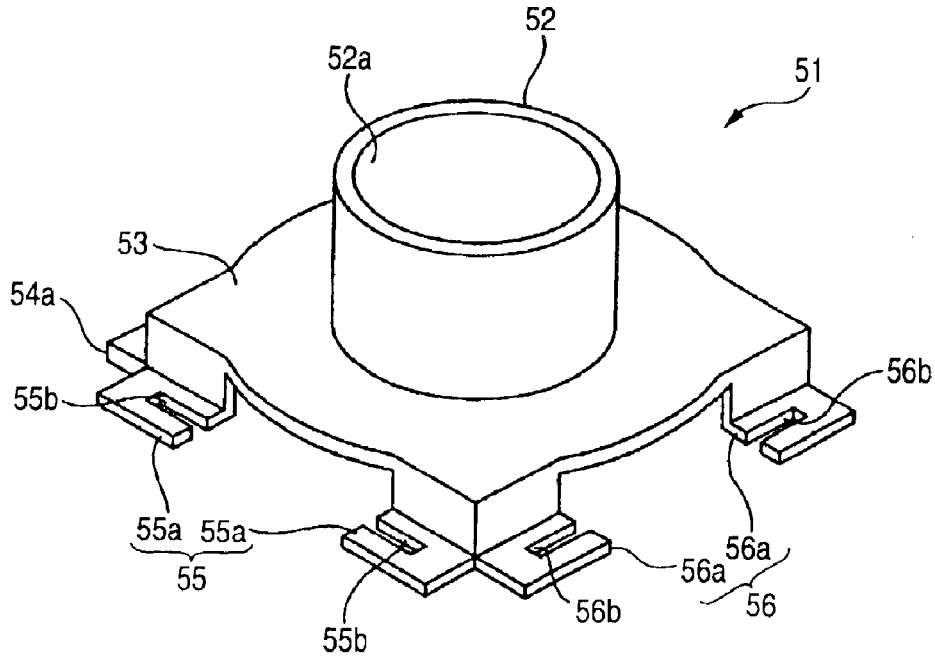
FIG. 10 is a perspective view of the seating of FIG. 9.

When respective portions shown in FIG. 9 are assembled along a center axis of transformer of the projection portion 50 of the respective ferrite core 46, both terminals of the winding are positioned opposite to each other and sandwich the feet portions directed to the same direction as the derive directions thereof. In other words, the terminals of each of these windings 10*p*1, 10*p*2, and 10*s* are derived from three directions among the four directions which are subdivided by 90 degrees around the center axis of the transformer 10B (with respect to this center axis, both primary winding 10*p*1 and primary winding 10*p*2 have an angular difference of 90 degrees, and both primary winding 10*p*2 and secondary winding 10*s* have an angular difference of 180 degrees).

Figure 11:
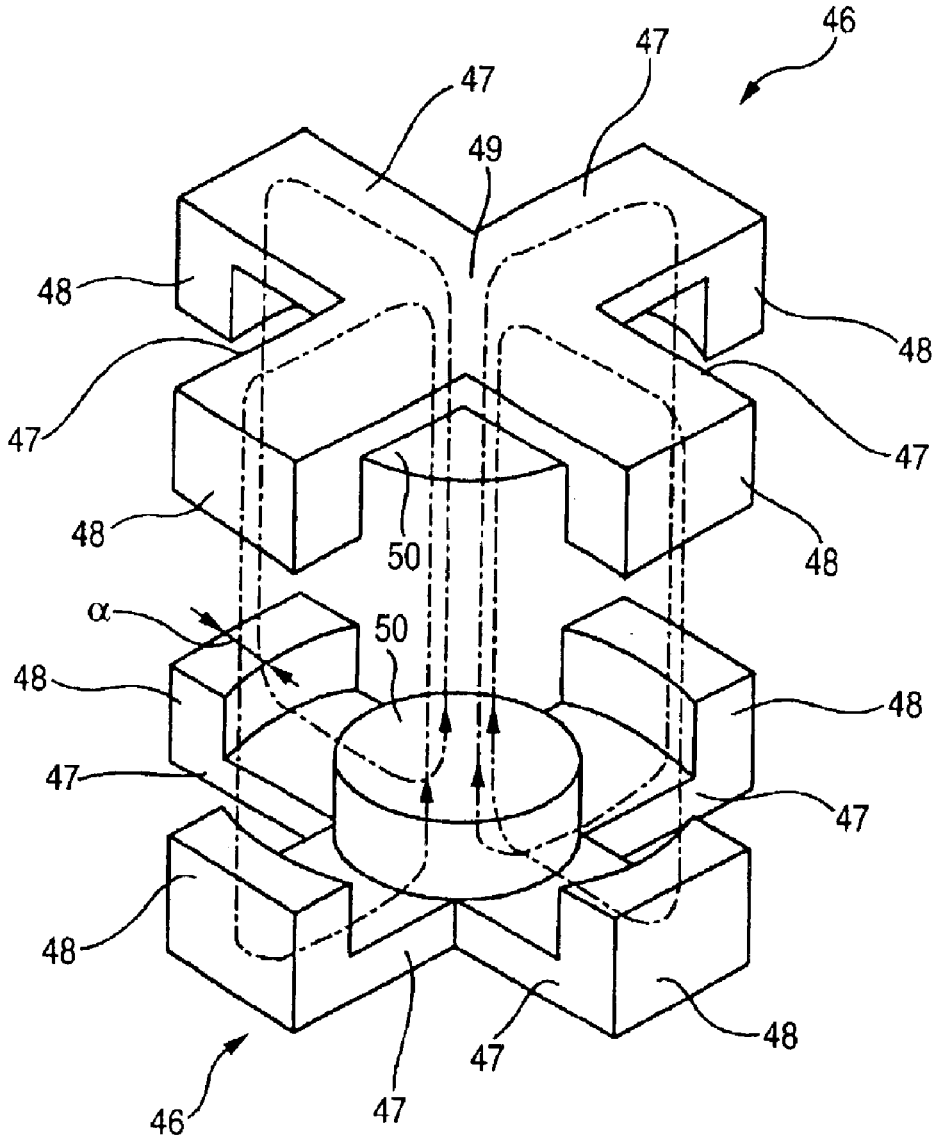
FIG. 11 is a diagram of magnetic flux which passes through a ferrite core of FIG. 9.

FIG. 11 shows magnetic paths formed in the ferrite cores 46 (both ferrite cores are showed under separate conditions).

Each of those ferrite cores 46 has four feet portions 47. Each of the ferrite cores 46 has edge portions 48 at those feet portions 47 that are used as outer feet. The projection portion 50 of the center portion 49 is used as a middle foot. The structural elements are located opposite to each other between the ferrite cores 46. As indicated by a dot and dash line of this drawing, the magnetic flux which passes through the middle foot in one ferrite core 46 is divided into four sets of magnetic flux, which pass through the outer feet of this ferrite core 26 respectively. Thereafter, the subdivided magnetic fluxes enter into the outer feet of the other ferrite core 46. Then, the magnetic fluxes are collected to the middle foot and again coupled to the middle foot of the first-mentioned core 46. The magnetic flux derived from the middle foot of one ferrite core 46 is spread along four directions so that the magnetic paths may be formed more radially than that in FIG. 8 within the ferrite cores 46. The magnetic flux can more easily pass through these radial-shaped magnetic paths.

Also, if leakage flux is negligible, the thickness ("$\alpha$" in FIG. 11) of the outer feet can be made thin because with respect to the cores, the magnetic flux that passes through the middle foot is made equal to a sum of the respective magnetic fluxes that pass through the respective outer feet. The reason for this is as follows: Because the ferrite core 46 has the four sets of outer feet, a sectional area per foot can be reduced with respect to the same magnetic flux. Furthermore, a transformer may be manufactured in such a way that a thickness of a core portion (rear surface) except for the outer feet in the ferrite core 46 is made thin. Although, this transformer is made compact and has a thin thickness, an inductance value of this compact transformer can be made relatively large. Also, the four-leg construction may be constructed in what is called a "pot core" construction where an unnecessary portion has been removed. This pot core construction is both light and compact. Also, because a surface area of this pot core structure can be made larger, a better heat radiation characteristics may be obtained.

Also, because the respective terminals of the primary windings 10*p*1 and 10*p*2 are not mutually connected to each other on the fixing portion in the structure of FIG. 9, the terminal connections are required when the transformer 10B is mounted on the circuit board.

Figure 12:
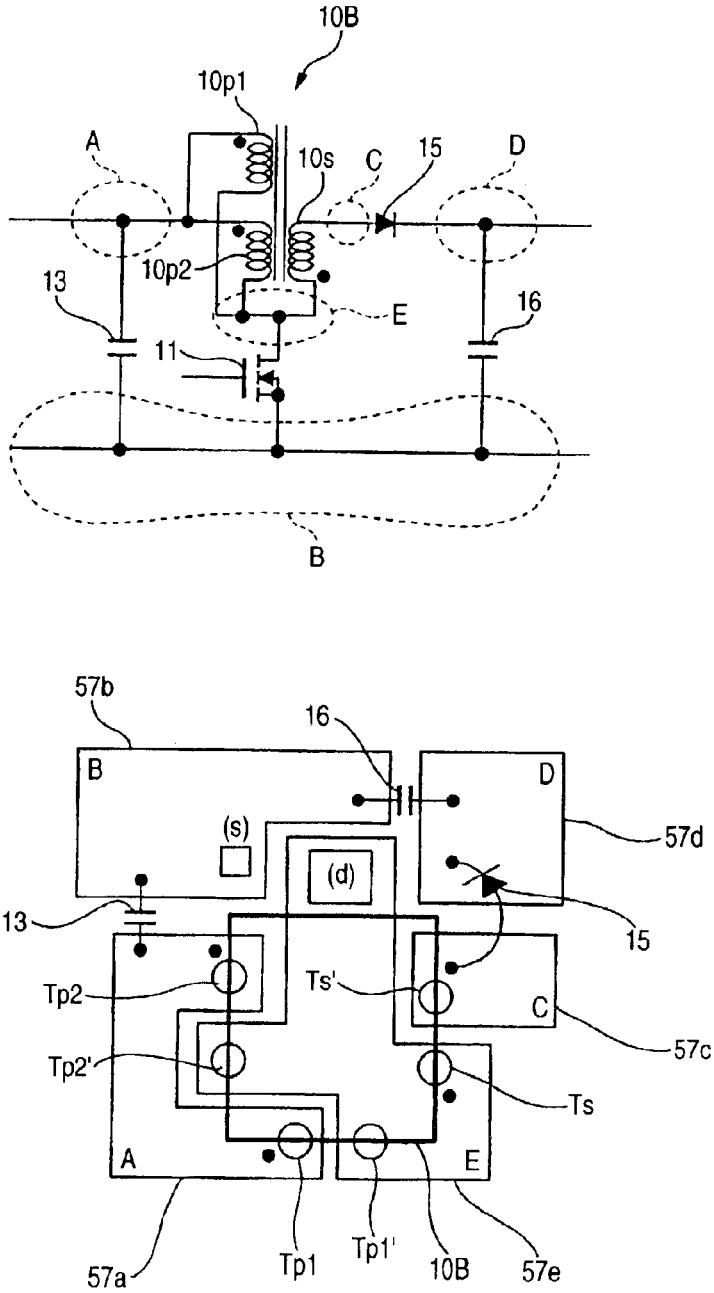
FIG. 12 is a diagram showing relationships between the respective windings of the transformer shown in FIG. 9 and the elements connected to these windings and relationships between the elements and conducting patterns of a circuit board.

A circuit diagram, which shows a transformer 10B, an FET functioning as switching element 11, a capacitor 13, a diode 15, and a capacitor 16, is provided in an upper portion of FIG. 12. A lower portion of this drawing indicates an arrangement of respective conducting patterns formed on a circuit board, and also, a connecting relationship among these conducting patterns and the respective circuit elements.

A corresponding relationship between the conducting patterns 57*a* to 57*e* and portions "A" to "E" that are indicated by broken lines in this circuit diagram is given as follows:

Conducting pattern 57*a* corresponds to A portion (connection portion among capacitor 13, and primary windings 10*p*1, 10*p*2);

Conducting pattern 57*b* corresponds to B portion (connection portion among capacitor 13, source of FET, and capacitor 16);

Conducting pattern 57*c* corresponds to C portion (connection portion between diode 15, and secondary windings 10*s*);

Conducting pattern 57*d* corresponds to D portion (connection portion between diode 15, and capacitor 16); and Conducting pattern 57*e* corresponds to E portion (connection portion among drain of FET, and respective windings 10*p*1, 10*p*2, 10*s*).

The transformer 10B is indicated by a rectangular shape of a wide line in the lower portion of this drawing. A terminal Tp1 and another terminal Tp1', which are indicated by circular symbols having white blanks, correspond to the respective terminals of the primary winding 10*p*1, whereas a terminal Tp2 and another terminal Tp2' correspond to the respective terminals of the primary terminal 10*p*2. The terminals Tp1 and Tp2 are connected to the same conducting pattern 57*a*, whereas the terminals Tp1' and Tp2' are connected to the same conductor pattern 57*e*. Also, a terminal Ts and another terminal Ts' correspond to the respective terminals of the secondary winding 10*s*. One terminal Ts is connected to the conductor pattern 57*e*, and the other terminal Ts' is connected to the conductor pattern 57*c*.

The capacitor 13 is connected by bridging the conducting patterns 57*a* and 57*b*. The capacitor 16 is connected by bridging the conducting patterns 57*b* and 57*d*. The anode of the diode 15 is connected to the conductor 57*c*. The cathode of the diode 15 is connected to the conducting pattern 57*d*.

In this drawing, symbol (s) written in the conduct pattern 57*b* indicates the source of the FET, and symbol (d) written in the conducting pattern 57*e* denotes the drain of the FET.

The switching element 11 (namely, FET in this example) is controlled in the high frequency mode in the above-described DC-to-DC converting circuit 3. When stray components (stray inductance) caused by the wiring lines and the circuit patterns are large, the transformer 10 cannot be sufficiently utilized. In particular, a circuit path derived from the capacitor 13 via the primary windings 10*p*1 and 10*p*2 and the FET returned to the capacitor 13 must be shortened as much as possible. In the present embodiment, the connection distance of such a path for bridging the conducting patterns 57*c*, 57*d*, 57*e* can be minimized.

To reduce unbalanced magnetic flux and the improve the coupling connections between the primary windings and the secondary winding for a cross type core, the circuit can be arranged such that the respective windings (coil wires) can pass through all feet portions (inside portions thereof) of this cross type core without any deviation. In other words, the terminals of the windings are derived from the space between the adjoining feet portions, and the directions of both the terminals of the winding are located substantially perpendicular to each other, as viewed from the direction along which the overlapping direction of the flat type windings. The fixing portions corresponding to the respective terminals of the windings are separately provided on the seating, and the terminals of the windings with respect to the respective fixing portions are fixed respectively and then are derived.

Figure 13:
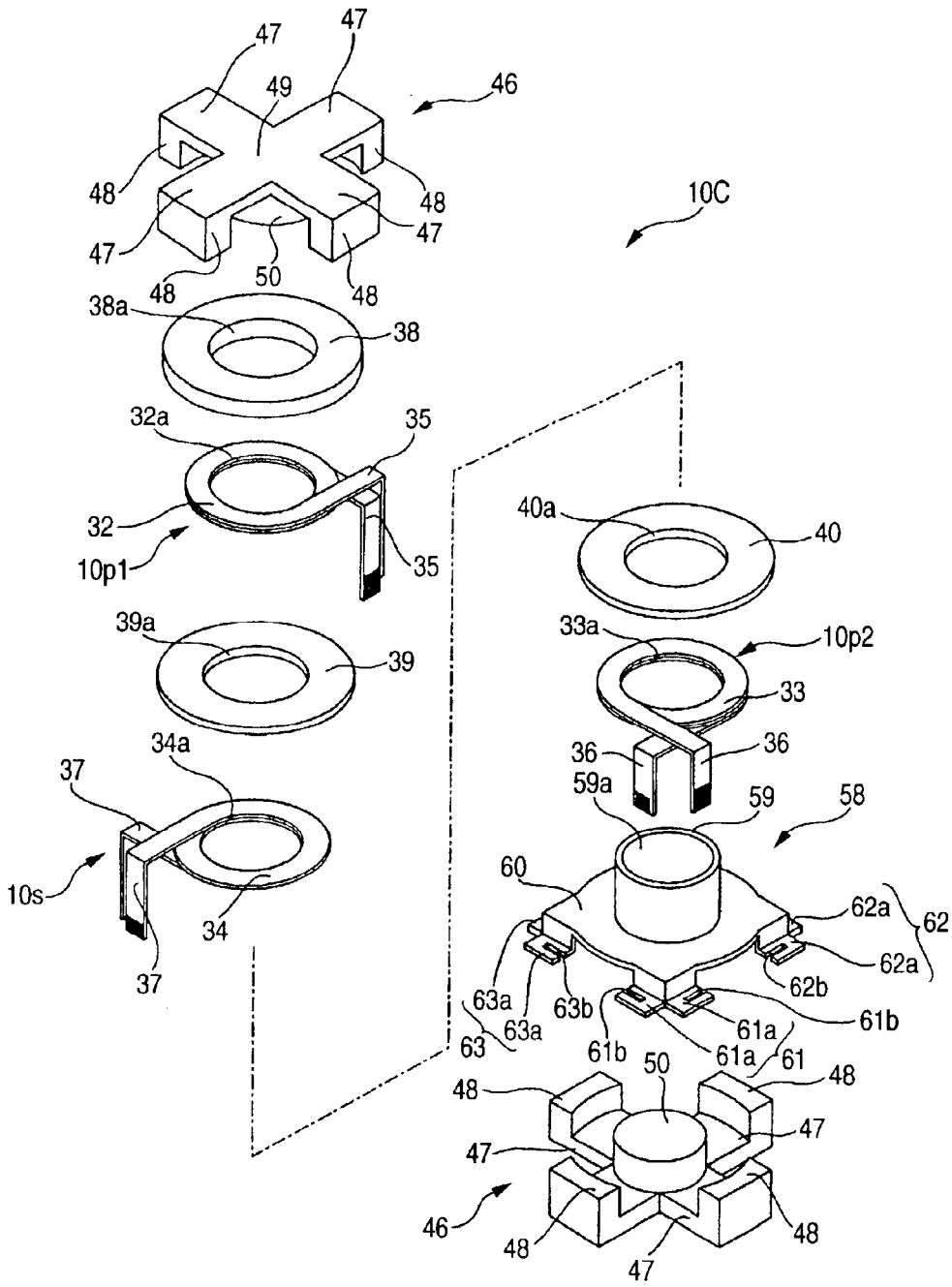
FIG. 13 is an exploded sectional view of a transformer according to an embodiment of the present invention.

FIG. 13 shows such a 9structural example 10C. Because structures of the respective windings and a seating of this example are different from the structure of FIG. 9, this difference will be explained.

With respect to the directions of the terminals of the primary windings 10*p*1 and 10*p*2 and of the secondary winding 10*s*, as shown in FIG. 9, winding portions of the windings which are located in the vicinity of the toroidal-shaped portions are positioned not parallel to each other, but perpendicular to each other. In other words, as viewed from a direction along an overlapping direction of the windings, winding portions, which are derived from the toroidal-shaped portion along a tangential direction, are located perpendicular to each other and intersect each other. Thereafter, they are bent in L-character shapes.

While the direction related to the terminals 36 of the primary winding 10*p*2 is used as a reference directions, the terminals of the primary winding 10*p*1 and the secondary winding 10*s* are derived in an angular interval of an angle of 90 degrees around a center axis of a toroidal-shaped portion (ring-shaped portion) which is extended along the overlapping direction of the respective windings. Lengths of L-shaped-bent portions of the respective terminals of these windings are made different from each other. The closer such a winding is located with respect to the fixing portion of the seating 58, the shorter the length thereof is made.

A seating 58 includes a cylindrical portion 59 and a base portion 60 for supporting this cylindrical portion 59. However, the shape of this base portion 60 is different from the base structure of FIG. 6. In other words, as to the base portion 60, three sets of fixing portions 61, 62, and 63 are formed to fix the respective terminals of these primary/secondary windings 10*p*1, 10*p*2, and 10*s*. The fixing portion 61 connects to the primary winding 10*p*2, the fixing portion 62 connects to the primary winding 10*p*1, and the fixing portion 63 connects to the secondary winding 10*s*. In correspondence with the directions of both the edge portions of the respective windings, the orientations (directions of arrangement) of the respective fixing portions corresponding thereto are made different from each other.

A base portion 60 includes a circular plate having a central circular hole that is combined with a rectangular plate. At four corners of this base portion 60, feet pieces 61*a*, 62*a*, and 63*a*, which are bent in L-character shapes, are formed.

The fixing portion 61 includes the feet pieces 61*a*, which are formed adjacent to each other at a corner portion of the base portion 60. Notches 61*b* are formed in these feet pieces 61*a*. After the terminals 36 of the primary winding 10*p*2 are inserted into the respective notches 61*b*, tip portions of these terminals 36 are bent in L-character shapes and then are fixed to the respective feet pieces 61*b*.

Similarly, the fixing portion 62 includes the feet pieces 62*a* which are formed adjacent to each other at another corner portion within the base portion 60. Notches 62*b* are formed in these feet pieces 62*a* of this fixing portion 62. After the terminals 35 of the primary winding 10*p*1 are inserted into the respective notches 62*b*, tip portions of these terminals 35 are bent in L-character shapes and then are fixed to the respective feet pieces 62*a*. Also, the fixing portion 63 includes the feet pieces 63*a*, which are formed at a corner portion located in a diagonal position with respect to the above described fixing portion 63. Notches 63*b* are formed in the feet pieces 63*a* of this fixing portion 63. After the terminals 37 of the secondary winding 10*s* are inserted into the respective notches 63*b*, tip portions of these terminals 37 are bent in L-character shapes and then are fixed to the respective feet pieces 63*a*.

Dimensional relationships of the projection portion 50 of the core 46, the cylindrical portion 59 of the seating 58, the spacers 38 to 40, and the toroidal-shaped portions 32 to 34 of the respective windings are similar to those in FIG. 6 and FIG. 9. An outer diameter of the projection portion 50 is made smaller than an inner diameter of the cylindrical portion 59 (diameter of hole 59*a*), and also, an outer diameter of the cylindrical portion 59 is made smaller than a hole diameter of each of the spacers 38 to 40 and a hole diameter of each of the winding toroidal-shaped portions 32 to 34.

Figure 14:
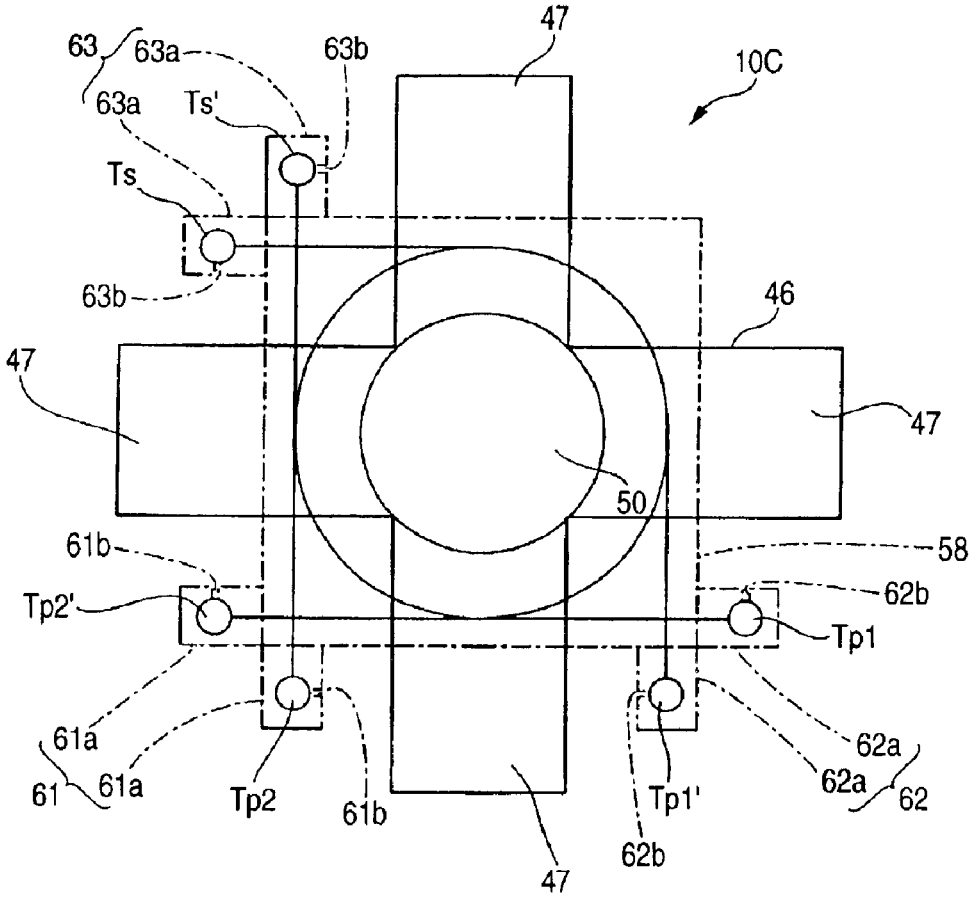
FIG. 14 is a diagram of the cores, the windings, and the seating of the transformer shown in FIG. 13.

FIG. 14 schematically shows the transformer 10C viewed from a direction along a center axis (namely, center axis of transformer) of the projection portion 50 of the respective ferrite core 46.

In FIG. 14, symbols "Tp1" and "Tp1'" show the terminals of the primary winding 10*p*1; symbols "Tp2" and "Tp2'" indicate the terminals of the primary winding 10*p*2; and symbols "Ts" and "Ts'" represent the terminals of the secondary winding 10S.

The terminals of each of these windings are derived between two feet portions which are located adjacent to each other at an angle of 90 degrees. With the center portion of the cross type core as a reference, symbols "Ts" and "Ts'" would be located on the upper left side of this drawing and symbols "Tp2" and "Tp2'" would be located at a lower portion of this drawing. The symbols "Tp1" and "Tp1'" are located opposite to the side of symbols "Tp2" and "Tp2'" with a core portion extending along the upper/lower direction of this drawing sandwiched. As previously explained, the direction of one terminal related to a winding is set to a direction directed along one of two feet portions adjacent to each other (with respect to axis perpendicular to the paper plane of drawing and passing through the center of core portion). That is, it is a direction that is located substantially parallel to an extending direction of a feet portion. Also, the direction of the other terminal related to this winding is set to a direction along the other feet portion. That is, it is a direction that is located substantially parallel to the extending direction of the feet portion.

Even if a turn number is equal to one, the flat type wires described above can be routed over all of the feet portions with respect to the cross type core. Thus, the coupling among these windings can be sufficiently secured.

Figure 15:
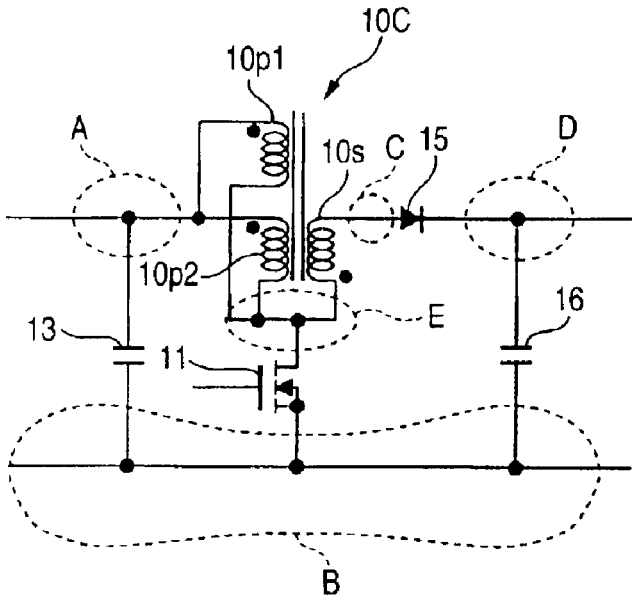
FIG. 15 is a diagram showing relationships between the respective windings of the transformer shown in FIG. 13 and the elements connected to these windings and a relationships between the elements and conducting patterns of a circuit board.
Figure 15:
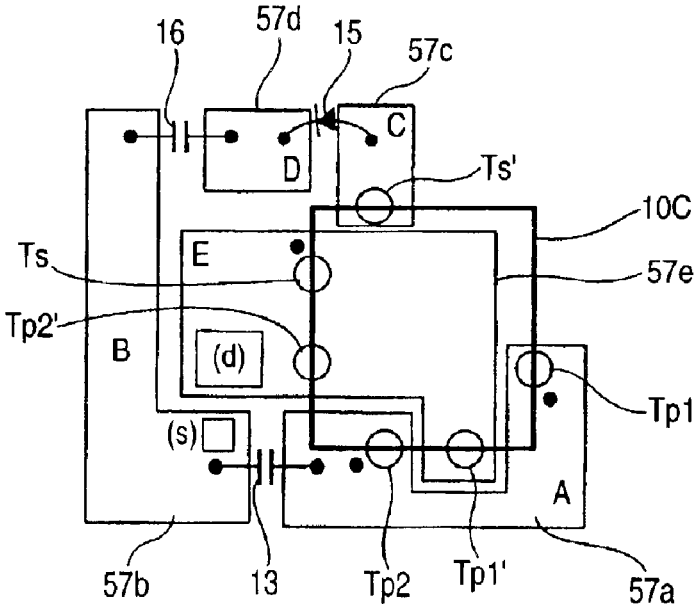

In an upper portion of FIG. 15, a circuit diagram illustrating a transformer 10C, an FET functioning as switching element 11, a capacitor 13, a diode 15, and a capacitor 16 is shown. The lower portion of this drawing illustrates an arrangement of respective conducting patterns formed on a circuit board. A relationship between these conducting patterns and the respective circuit elements of FIG. 15 is similar to those of FIG. 12 (circuit diagram is similar to upper circuit diagram of FIG. 12 except for differences in transformers).

The respective conducting patterns are similar to the above-explained conducting patterns 57*a* to 57*e* except for differences in shapes thereof (accordingly, same reference numerals are employed in FIG. 15).

Although the deriving positions of the terminals of the windings in the transformer 10C are different from those of the above-explained transformer 10B, basic relationships thereof in terms of connections are identical to each other. That is, terminals Tp1 and Tp2, which are indicated by circular symbols having white blanks, are connected to the same conducting pattern 57*a*, and the terminals Tp1', Tp2', and Ts are connected to the same conducting pattern 57*e*. Also, the terminal Ts' is connected to the conducting pattern 57*c*. A relationship among the capacitor 13, the diode 15, and the FET with respect to the respective conducting patterns is the same as that of FIG. 12. Also, in this embodiment, because the distance of the paths for bridging the conducting patterns 57*a*, 57*b*, 57*e* is minimized, the adverse influence of the stray components caused by the wiring lines and the circuit patterns can be reduced.

In accordance with one embodiment, because the flat type wire is used, the copper loss (load loss) caused by the skin effect can be reduced and because a plurality of windings and the core are arranged along the overlapping direction of the flat type wire, the electromagnetic coupling conditions between the windings can be improved. Therefore, the electric efficiency of the transformer can be increased and the transformer can be made compact.

In another embodiment, the electric insulation between the windings and also between the winding and the core can be secured, and the complex construction caused by this electric insulation can be avoided.

In another embodiment, because the fixing portions of the winding terminals are formed on the insulating member, the construction can be made simple.

In still another embodiment, the coupling condition between the primary windings and the secondary winding can be improved.

In another embodiment, the core shape can be made simple, and also, the respective winding terminals can be derived from the side surface of this core, so that the respective windings can be easily discriminated from each other.

In still another embodiment, because the directions of the terminals are different from each other at every winding, workability can be increased.

In another embodiment, because the thickness of the core can be made thin, the transformer can be made compact and in light weight. Also, the heat radiation characteristic thereof can be improved. The directions of the respective terminals of these windings are routed along the feet portions, so that these directions can be clearly discriminated from each other.

In another embodiment, because the balance of the magnetic flux is maintained, deteriorations of the coupling between the windings can be prevented.

The present invention claims priority from Japanese patent application serial no. 2002-128191 filed on Apr. 30, 2002, which is incorporated by reference herein in its entirety.

Several embodiments of the invention have been described herein, but it should be understood that various additions and modifications could be made which fall within the scope of the following claims.

What is claimed is:

1. A transformer comprising:

a coil including a plurality of windings; and a plurality of cores sandwiching said coil, wherein each of said windings of the coil has a toroidal-shaped portion, which is formed by winding and overlapping a flat type wire in a toroidal shape, and ends of said flat type wire extend from said toroidal-shaped portion;

said plurality of windings and said plurality of cores are coupled in a direction along which said flat type wire overlaps;

an insulating member disposed between said windings and said cores to insulate said windings and said cores; and a fixing portion provided on said insulating member to fix terminals of said windings.

2. The transformer as claimed in claim 1 further comprising:

an insulating member disposed one of between said plurality of windings and between said windings and said cores.

3. The transformer as claimed in claim 1, wherein a shape of each core is substantially rectangular, as viewed from a direction along which said flat type wire overlaps;

said plurality of windings includes a first winding and a second winding; and a terminal of the first winding and a terminal of the second winding extend from the toroidal shaped portion 90 degrees apart.

4. The transformer as claimed in claim 1, wherein the plurality of windings includes at least two primary windings and a secondary winding; and the secondary winding is sandwiched between the two primary windings.

5. The transformer as claimed in claim 4, wherein a direction of the terminals of the two primary windings, and a direction of terminals of said secondary winding are arranged respectively in an angular interval of approximately 90 degrees around an axis along which said flat type wire overlaps.

6. A transformer comprising:

a core including a plurality of windings; and a plurality of cores sandwiching said coil, wherein each of said windings of the coil has a toroidal-shaped portion, which is formed by winding and overlapping a flat type wire in a toroidal shape, and ends of said flat type wire extend from said toroidal-shaped portion;

said plurality of windings and said plurality of cores are coupled in a direction along which said flat type wire overlaps;

wherein the plurality of windings includes at least two primary windings and a secondary winding, the secondary winding being sandwiched between the two primary windings, wherein a direction of terminals of the two primary windings, and a direction of terminals of said secondary winding are arranged respectively in an angular interval of approximately 90 degrees around an axis along which said flat type wire overlaps, and wherein each said core has four feet portions; said four feet portions have a substantially cross shape, as viewed from a direction along which said flat type wire overlaps; and terminals of the primary and secondary windings are positioned opposite to each other, while sandwiching the feet portions which are directed to the directions of the terminals.

7. A transformer comprising:

a coil including a plurality of windings; and a plurality of cores sandwiching said coil, wherein each of said windings of the coil has a toroidal-shaped portion, which is formed by winding and overlapping a flat type wire in a toroidal shape, and ends of said flat type wire extend from said toroidal-shaped portion;

said plurality of windings and said plurality of cores are coupled in a direction along which said flat type wire overlaps;

wherein the plurality of windings includes at least two primary windings and a secondary winding, the secondary winding being sandwiched between the two primary windings, wherein a direction of terminals of the two primary windings, and a direction of terminals of said secondary winding are arranged respectively in an angular interval of approximately 90 degrees around an axis along which said flat type wire overlays, and wherein each said core has four feet portions; said four feet portions have a substantially cross shape, as viewed from a direction along which said flat type wire overlaps; and terminals of the winding extend from a space between two sets of adjoining feet portions spaced apart by 90 degrees, a direction of one terminal is substantially parallel to one feet portion, and, a direction of the other terminal is substantially parallel to the other feet portion.

* * * * *